US006486617B2

(12) United States Patent
Pilz et al.

(10) Patent No.: US 6,486,617 B2
(45) Date of Patent: Nov. 26, 2002

(54) DEVICE FOR CONTROLLING LIGHT SOURCES HAVING A BALLAST

(75) Inventors: Axel Pilz, Neuenstein (DE); Andreas Huber, Traunreut (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/798,998

(22) Filed: Mar. 6, 2001

(65) Prior Publication Data

US 2001/0022501 A1 Sep. 20, 2001

(30) Foreign Application Priority Data

Mar. 10, 2000 (DE) ..... 100 11 306

(51) Int. Cl.[7] ..... G05F 1/00

(52) U.S. Cl. ..... 315/291

(58) Field of Search ..... 315/291, 292, 315/293, 299, 307, DIG. 4

(56) References Cited

U.S. PATENT DOCUMENTS 4,733,138 A * 3/1988 Pearlman et al. ..... 315/307
5,159,185 A * 10/1992 Lehr ..... 250/205
6,188,181 B1 * 2/2001 Sinha et al. ..... 315/293
6,118,231 A1 * 9/2001 Geiginger et al. ..... 315/312

FOREIGN PATENT DOCUMENTS

EP 0 688 153 A2 12/1995

* cited by examiner

*Primary Examiner*—Don Wong
*Assistant Examiner*—Minh Dieu A
(74) *Attorney, Agent, or Firm*—Carlo S. Bessone

(57) ABSTRACT

The invention relates to a device for controlling light sources (30–35) having a ballast (20–23) includes a set point generator for prescribing a brightness set point for the light sources (30–35), and having means for generating a control signal, dependent on the set point of the set point generator, for the purpose of brightness control of the light sources (30–35). According to the invention, the device has means for adapting the control signal to different types of light sources. The device according to the invention renders possible uniform dimming of different types of light sources which are installed in a lighting system.

9 Claims, 2 Drawing Sheets

DEVICE FOR CONTROLLING LIGHT SOURCES HAVING A BALLAST

Figure 1:
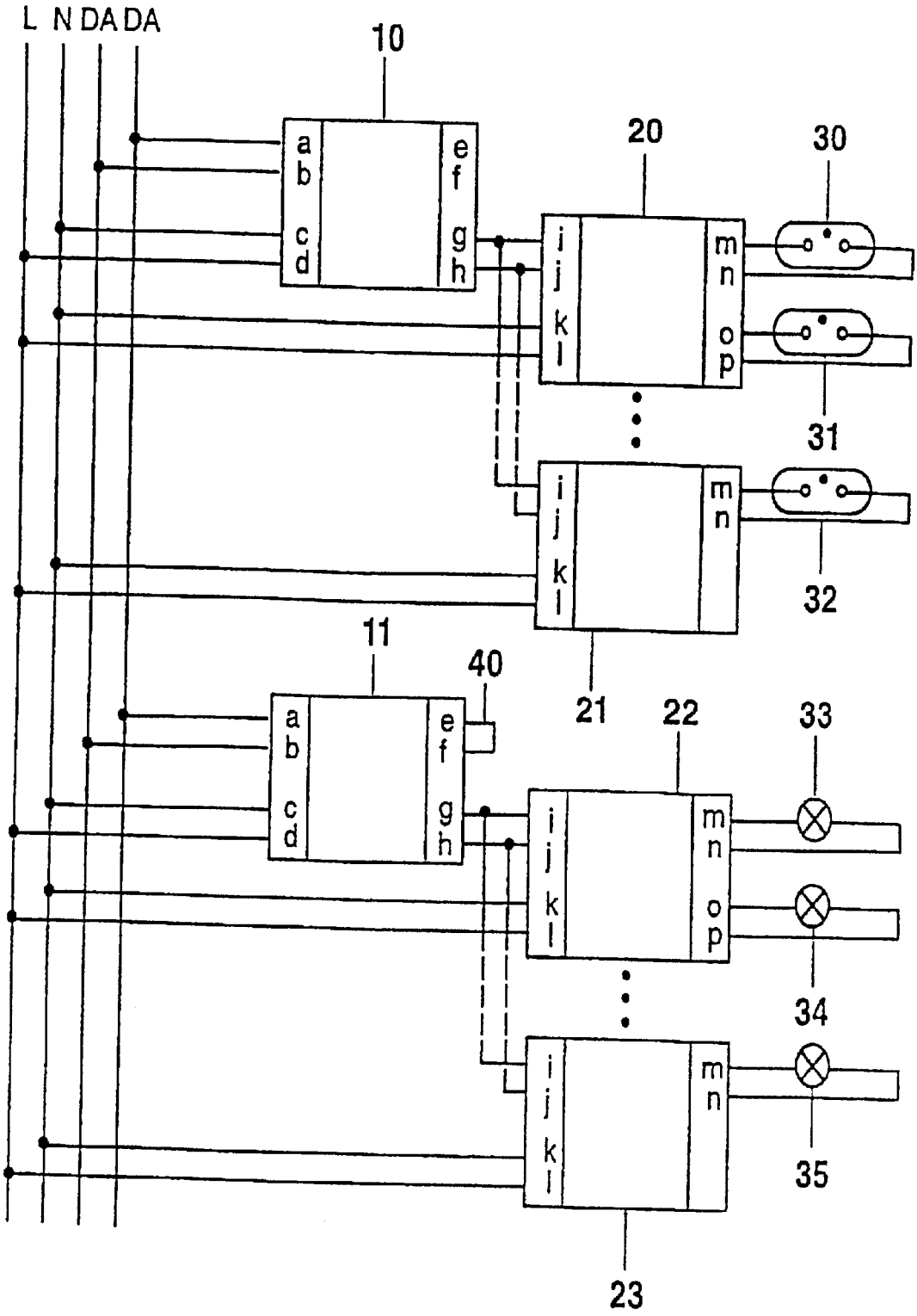

The invention relates to a device for controlling light sources having a ballast.

I. TECHNICAL FIELD

Such devices are a component of ballasts for electric light sources and are intended for use in lighting systems whose light sources are switched on and off and dimmed with the aid of a central operator's or control console. Usually, a plurality of light sources, for example the light sources of a room, are jointly controlled by a control element of the control console. These light sources, which are combined into a group, are switched on and/or off or dimmed by actuating the same control element. By actuating a control element, for example a dimmer, a brightness set point is prescribed for a group of light sources, and converted with the aid of a device into a corresponding control signal which is used for brightness control of the light sources connected to the ballasts. The value of the control signal required for this depends, on the one hand, on the prescribed brightness set point and, on the other hand, on the type of the light sources to be operated.

II. PRIOR ART

European Laid-Open Specification EP 0 688 153 A2 discloses a circuit arrangement for controlling the brightness and the operational performance of gas discharge lamps. The circuit arrangement has a receiving device which can be fed commands for controlling the brightness of gas discharge lamps via a digital control input. These commands are converted into a corresponding control voltage for setting the desired brightness of the gas discharge lamps by means of a function element which acts in a logarithmic or exponential fashion. The function element acting in a logarithmic or exponential fashion is specifically tuned to the brightness control of gas discharge lamps and permits only inadequate brightness control with other types of light sources, since a transfer function for adapting the light source to the physiological sensitivity of the human eye is required.

III. SUMMARY OF THE INVENTION

It is the object of the invention to provide a device for controlling light sources having a ballast, which renders it possible in the case of lighting systems with light sources of different type to reduce and/or to increase the brightness of these light sources jointly and to the same extent.

According to the invention, this object is achieved for a device of, the generic type by the characterizing features of Patent Claim 1. Particularly advantageous designs of the invention are described in the subclaims.

The device according to the invention for controlling light sources having a ballast can be connected to a set point generator for setting a brightness set point for the light sources, and has means for generating a control signal, dependent on the set point of the set point generator, for brightness control of the light sources, as well as means for adapting the control signal to different types of light sources. This ensures that different types of light sources which are combined in a lighting system into a group of light sources to be jointly switched can be dimmed to the same extent. It is ensured, in particular, that, owing to the prescription of a brightness set point for the aforementioned group of light sources, each of these light sources is operated with the same dimming level even when they are of different type. The same dimming level means here that the light sources in this operating state output the same relative luminous flux in each case. For example, the prescription of the dimming level at 70% means that each light source of the group outputs 70% of its maximum luminous flux. The device according to the invention converts the brightness set point prescribed by the set point generator into a control signal which is adapted to the type of light source to be operated and is used for brightness control of the light sources.

The means for generating the control signal or/and the means for adapting the control signal to different types of light sources advantageously include means for generating first control signal values whose dependence on the set point can be described by a first control signal set point characteristic curve, and means for generating second control signal values and possibly further control signal values whose dependence on the set point can be described by a second control signal set point characteristic curve and/or by further control signal set point characteristic curves, and, furthermore, means for selecting the first control signal values or the second control signal values or the possibly further control signal values such that the first or the second or the possibly further control signal values can optionally be used for brightness control of the light sources. As a result, the device according to the invention can be used to adapt the control voltage to at least two different types of light sources, which require a different control signal for setting the desired brightness set point. The first control signal set point characteristic curve advantageously has a substantially linear course, and the second control signal set point characteristic curve advantageously has a nonlinear, preferably a substantially exponential or logarithmic course, or one which can be represented by a polynomial of higher degree. The control signal set point characteristic curve with the substantially linear course is tuned to the brightness control of incandescent lamps, and the control signal set point characteristic curve with the non-linear course is tuned to the brightness control of fluorescent lamps.

The means for adapting the control signal to different types of light sources advantageously comprise a programmable microprocessor or a programmable logic circuit or an analogue circuit which can be operated in a program-controlled fashion. In these cases, the aforenamed different control signal set point characteristic curves can be stored in a fashion capable of being called in a nonvolatile storage means. The means for selecting the first or second and/or further control signal values are advantageously designed as switching means which render it possible to switch over between the corresponding control signal set point characteristic curves. It is possible in this way to adapt the control signal to the type of the light sources to be operated by switching over manually or automatically to the corresponding control signal set point characteristic curve. However, it is also possible to design the means for selecting the first or the second and/or the further control signal values as control signal outputs such that at least one separate control signal output is respectively assigned to the first and the second as well as the possibly further control signal values.

The device according to the invention is advantageously accommodated in a separate housing and has at least one control signal output to which at least one ballast can be connected. The device according to the invention can, however, also be designed as a component of a ballast for electric light sources.

IV. BRIEF DESCRIPTION OF THE DRAWING(S)

Figure 2:
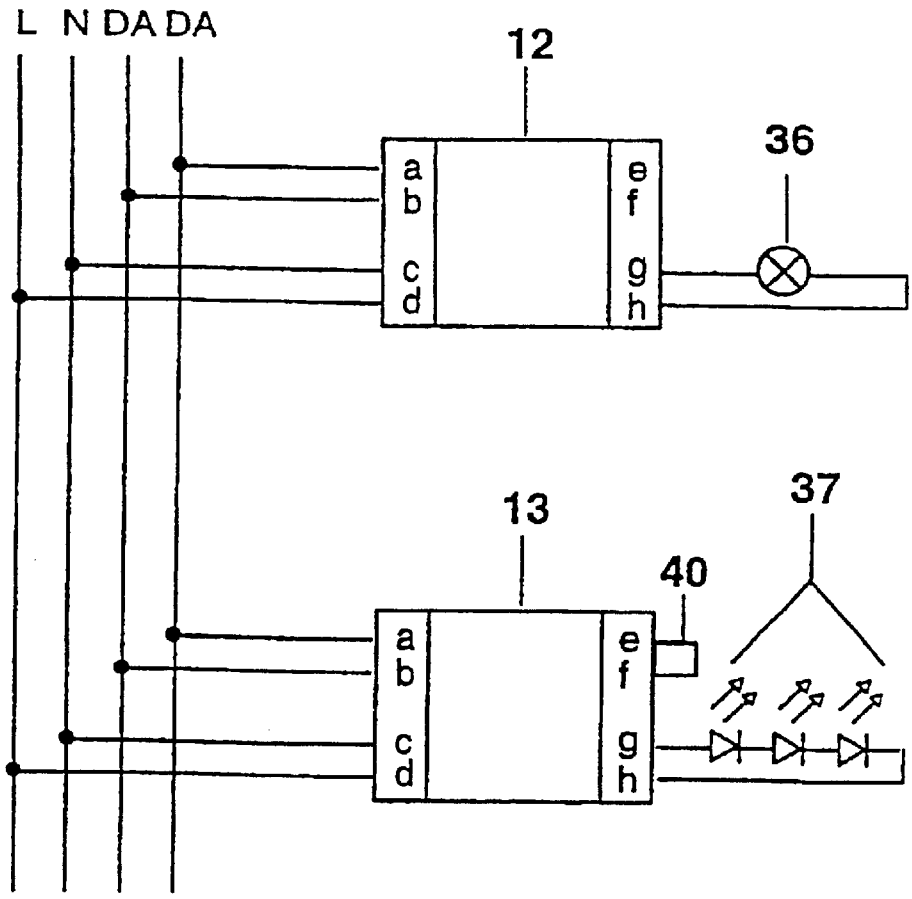
Figure 3:
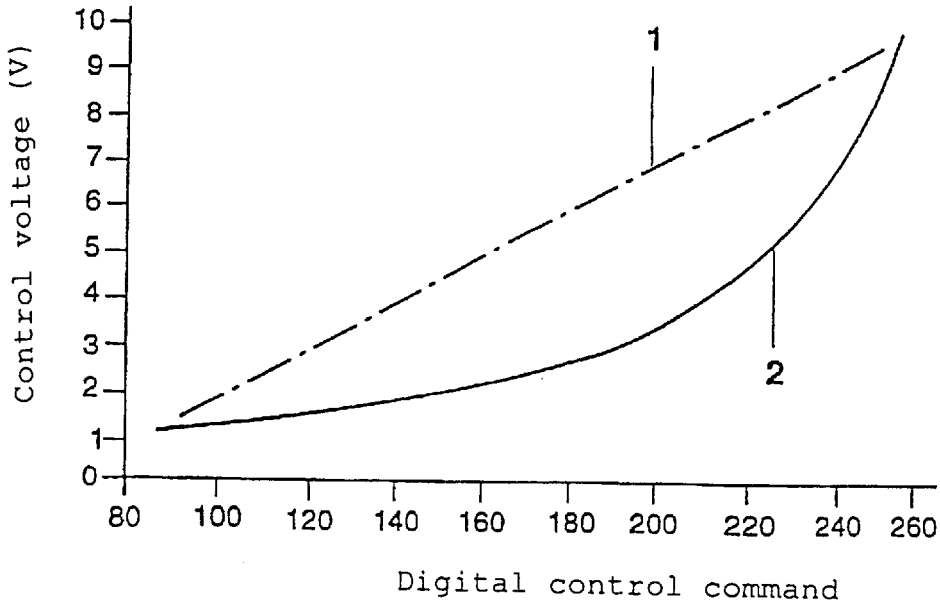

The invention is explained in more detail below with the aid of a preferred exemplary embodiment. In the figure:

FIG. 1 shows a diagrammatic illustration of two devices in accordance with the first exemplary embodiment of the invention, as part of a lighting system, FIG. 2 shows a diagrammatic illustration of two devices in accordance with the second exemplary embodiment of the invention, as part of a lighting system, FIG. 3 shows a diagrammatic illustration of the different control signal set point characteristic curves of the device according to the invention.

V. DESCRIPTION OF THE PREFERRED EMBODIMENT(S)

The devices 10, 11, illustrated in FIG. 1, in accordance with the first exemplary embodiment of the invention are converters 10, 11 which are fitted with electric terminals a to h and convert digital control commands into a corresponding control voltage for the ballasts 20 to 23. The ballasts 20 to 23 serve to operate the light sources 30 to 35. FIG. 1 also shows the integration of the converters 10, 11 with a lighting system which, moreover, also comprises the mains voltage lines L, N, a central control console (not illustrated), which is provided with control elements for switching on and off and for dimming the light sources 30 to 35, data transmission lines DA and a plurality of ballasts 20 to 23 as well as numerous light sources 30 to 35. The mains voltage lines L, N serve to supply voltage to the converters 10, 11 and ballasts 20 to 23, and are connected for this purpose to the mains voltage terminals c, d of the converters 10, 11 and to the mains voltage terminals k, l of the ballasts 20 to 23. The data transmission lines DA connect the control command output of the control console (not illustrated) to the control command inputs a, b of the converters 10, 11. Set points, prescribed by means of the control elements at the control console (not illustrated), for the operating states of the light sources 30 to 35 are transmitted to the converters 10, 11 via these data transmission lines DA. The aforementioned set points for the operating states of the light sources 30 to 35, in particular for the desired dimming level, reach inputs a, b of the converters 10, 11 in the form of digital control commands. The converters 10, 11 convert the digital control commands into corresponding control signals which are provided at the control signal outputs g, h of the converters 10, 11. The control signal outputs g, h of the converter 10 are connected to the control signal inputs i, j of the ballasts 20, 21, and the control signal outputs g, h of the converter 11 are connected to the control signal inputs i, j of the ballasts 22, 23. A control voltage which can assume values between 0 V and 10 V serves as control signal. The ballasts 20 to 23 operate the light sources 30 to 35 connected to their voltage outputs m, n, o, p as a function of the aforementioned control voltage. The instantaneous operating state of the light sources 30, 31, 32, 33, 34 or 35 connected to any desired ballast 20, 21, 22 or 23 therefore depends on the current value of the control voltage at the control signal input i, j of the corresponding ballast 20, 21, 22 or 23. The light sources 30 to 32 illustrated diagrammatically in FIG. 1 are fluorescent lamps, and the light sources 33 to 35 are electric incandescent lamps. The ballasts 20, 21 are therefore designed as operational equipment for fluorescent lamps—for example as electronic ballasts which have an externally controlled half-bridge inverter with downstream series resonant circuit—, while the ballasts 22, 23 are operational equipment for incandescent lamps—for example electronic transformers or dimmers. Consequently, the converter 10 is adapted to the control of operational equipment for fluorescent lamps, and the converter 11 is adapted to the control of operational equipment for incandescent lamps. The contact bridge 40 and the pins e, f of the converters 10, 11 serve to adapt the converters 10, 11 to the two aforementioned different types of operational equipment. In the case of the converter 11, the pins e, f are connected to one another in an electrically conducting fashion by the contact bridge 40, while in the case of the converter 10 the pins e, f are not connected to one another. By removing the contact bridge 40, or plugging it onto the pins e, f, the converters 10, 11 are adapted to the two different types of ballasts 20, 21, on the one hand, and 22, 23, on the other hand.

The converters 10, 11 are fitted in each case with a programmable microprocessor (not illustrated) and a nonvolatile storage means (not illustrated). With the aid of the programmable microprocessor and the nonvolatile storage means, the digital control commands, which are present at the inputs a, b of the converter 10 or 11, are assigned corresponding control voltage values which are provided at the control voltage output g, h of the converter 10 or 11 for the ballasts 20, 21 or 22, 23 connected thereto. By plugging the contact bridge 40 onto the pins e, f of the converters 10, 11, or removing it therefrom, one of the two control signal set point characteristic curves illustrated in FIG. 3, which in each case assign a corresponding control signal to each set point for the brightness of the light sources 30 to 35, is selected. In the case of the exemplary embodiments described here, the brightness set point is prescribed by a digital control command. Each digital value of the control command is assigned a corresponding control signal value by the converters 10, 11 by means of the program-controlled microprocessor, that is to say it is assigned a corresponding control voltage value between 1 V and 10 V. Illustrated in FIG. 3 is a substantially linear characteristic curve 1 and a non-linear characteristic curve 2 which describe an approximately linear dependence of the control voltage on the digital control command, or an extremely nonlinear dependence of the control voltage on the digital control command. The converter 10, in which the pins e, f are not connected by a contact bridge 40, provides at its control signal output g, h a control voltage which follows the course of the nonlinear characteristic curve 2 and which is provided for controlling ballasts 20, 21 for fluorescent lamps 30 to 32. The converter 11, in which the pins e, f are connected by a contact bridge 40, provides at its control signal output g, h a control voltage which follows the course of the substantially linear characteristic curve 1 and is provided for the purpose of controlling ballasts 22, 23 for incandescent lamps 33 to 35. The converters 10, 11 ensure that the fluorescent lamps 30 to 32 and the incandescent lamps 33 to 35 can be dimmed simultaneously, and specifically to the same extent, by prescribing a digital control command value. Each digital control command value, which is transmitted by means of the data transfer lines DA from the control console and is determined for both converters 10, 11 and serves for the brightness control of the light sources 30 to 35, is converted by means of the converters 10, 11 into a corresponding control voltage for the ballasts 20 to 23, such that all light sources 30 to 35 output approximately the same relative luminous flux, irrespective of their type. Consequently, irrespective of the type of light source, a specific relative luminous flux or a specific dimming level corresponds to each prescribed digital control command value serving to control brightness. For example, a relative luminous flux of 40% corresponds to the digital control command value "220". With the aid of the converters 10, 11, this control command value is converted into a control voltage, adapted to the ballasts 20, 21 and 22, 23, respectively, of approximately 5 V and approximately 8 V, respectively, such that both the fluorescent lamps 30 to 32 and the incandescent lamps 33 to 35 are operated at the dimming level 40%, that is to say output 40% of their maximum luminous flux in each case.

A second exemplary embodiment of the invention is illustrated diagrammatically in FIG. 2. The device according to the invention is here a component of the ballasts 12, 13. The ballast 12 is an electronic transformer or a dimmer for operating an incandescent lamp 36, while the ballast 13 is designed as a driver circuit for a multiplicity of light-emitting diodes 37. The device according to the invention for adapting the control voltage to the type of light source in each case has a programmable microprocessor and a non-volatile storage means as well as pins e, f which can be connected by means of the contact bridge 40. The control voltage, provided at the voltage output g, h, for the light sources 36 or 37 can be adapted to the brightness control of incandescent lamps or light-emitting diodes by removing or plugging on the contract bridge 40. The assignment rule, which assigns to each digital control command at the control input a, b a corresponding value for the control voltage at the control voltage output g, h, is stored in the case of this exemplary embodiment, as well, in the form of two different control signal set point characteristic curves which are selected by plugging on or removing the contact bridge 40. By contrast with the first exemplary embodiment, here the control voltage serves not to control the ballasts of the light sources, but to operate the light sources 36, 37. The reference symbols L, N, DA, c, d have the same meaning as the corresponding reference symbols in the first exemplary embodiment.

The invention is not limited to the exemplary embodiments described in more detail above. For example, it is possible to use the device according to the invention to store and to select more than only two different control signal set point characteristic curves, such that it is possible to adapt the control signal for correspondingly many different types of light sources. Selection of the corresponding control signal set point characteristic curve can be performed in the case of more than two such characteristic curves by means, for example, of an encoding switch which has a corresponding number of switching stages. Instead of a switching means that is to be actuated manually, the converters 10, 11 or 12, 13 can, however, also have means for detecting the connected types of light sources, and means for automatically adapting the control voltage to the type of light source detected and to be operated. Alternatively, the means for selecting one of the control signal set point characteristic curves can be designed as means for receiving and for evaluating a control command, for example from an external control device, which triggers switching over between the different control signal set point characteristic curves. A further conceivable variant of the device according to the invention consists in providing a separate control signal output at the converter 10, 11 or 12, 13 for each different control signal set point characteristic curve, instead of the contact bridge 40 or instead of the encoding switch, such that, for example, a control signal for operating fluorescent lamps is provided at a first control signal output of the converter, a control signal for operating incandescent lamps is provided at a second control signal output, and a control signal for operating light-emitting diodes is provided at a further control signal output.

What is claimed is:

1. A device for controlling light sources having a ballast comprising:

means for generating a control signal, dependent on a set point of a set point generator, for brightness control of the light sources, means for adapting the control signal to different types of light sources, means for generating first control signal values whose dependence on the set point is described by a first control signal set point characteristic curve having a substantially linear course, means for generating second control signal values whose dependence on the set point is described by a second control signal set point characteristic curve having a substantially nonlinear course, means for selecting the first control signal values or the second control signal values such that the first or the second control signal values are used for brightness control of the light sources.

2. The device according to claim 1, wherein the means for adapting the control signal to different types of light sources comprise a programmable microprocessor.

3. The device according to claim 2, wherein the means for selecting the first control signal values or the second control signal values are designed as switching means which render it possible to switch over between the first control signal set point characteristic curve and the second control signal set point characteristic curve.

4. The device according to claim 2, wherein the means for selecting the first control signal values or the second control signal values are designed as means for receiving and for evaluating a control command which triggers switching over between the different control signal set point characteristic curves.

5. The device according to claim 1, wherein the means for adapting the control signal to different types of light sources are designed as a programmable logic circuit.

6. The device according to claim 1, wherein the means for adapting the control signal to different types of light sources are designed as an analogue circuit which can be operated in a program-controlled fashion.

7. The device according to claim 1, wherein the device has at least one control signal output to which the control signal can be applied and which can be connected to the ballast.

8. The device according to claim 1, wherein the device is a component of a ballast for operating light sources.

9. The device according to claim 1, wherein the means for selecting the first control signal values or the second control signal values are designed as control signal outputs, at least one separate control signal output being respectively assigned to the first control signal values and to the second control signal values.

* * * * *